US007007348B2

(12) United States Patent
Catry et al.

(10) Patent No.: US 7,007,348 B2
(45) Date of Patent: Mar. 7, 2006

(54) MACHINE FOR MAKING A NON-WOVEN MATERIAL BY AEROLOGICAL MEANS USING A DECREASING AIR FLOW

(75) Inventors: Xavier Catry, Hem (FR); Christian Vanbeselaere, Tourcoing (FR); Marc Brabant, Hem (FR)

(73) Assignee: Thibeau, Tourcoing (FR)

( * ) Notice: Subject to any disclaimer, the term of this patent is extended or adjusted under 35 U.S.C. 154(b) by 0 days.

(21) Appl. No.: 10/814,658

(22) Filed: Mar. 31, 2004

(65) Prior Publication Data

US 2004/0255430 A1 Dec. 23, 2004

(30) Foreign Application Priority Data

Apr. 1, 2003 (FR) ..... 03 04048

(51) Int. Cl.
*D01G 25/00* (2006.01)

(52) U.S. Cl. ..... 19/304

(58) Field of Classification Search ..... 19/98, 19/99, 101, 106 R, 65 A, 115 R, 145.7, 161.1, 19/296, 300, 301, 302, 303, 304, 308, 151
See application file for complete search history.

(56) References Cited

U.S. PATENT DOCUMENTS

| | | | | |
|---|---|---|---|---|
| 4,097,965 A | | 7/1978 | Gotchel et al. | |
| 4,375,448 A | * | 3/1983 | Appel et al. | 264/518 |
| 4,432,714 A | | 2/1984 | Forry et al. | |
| 4,475,271 A | * | 10/1984 | Lovgren et al. | 19/105 |
| 5,361,451 A | | 11/1994 | Fehrer | |
| 5,584,101 A | * | 12/1996 | Brabant et al. | 19/304 |
| 5,974,631 A | * | 11/1999 | Leifeld | 19/304 |
| 6,195,845 B1 | | 3/2001 | DuPont et al. | |
| 2002/0086072 A1 | | 7/2002 | Clark et al. | |

FOREIGN PATENT DOCUMENTS

| | | |
|---|---|---|
| AT | 395 610 | 2/1993 |
| EP | 0 093 585 | 11/1983 |
| FR | 2 824 082 | 10/2002 |

* cited by examiner

*Primary Examiner*—Gary L. Welch
(74) *Attorney, Agent, or Firm*—Weingarten, Schurgin, Gagnebin & Lebovici LLP

(57) ABSTRACT

The machine for making a non-woven material aerologically has a forming and conveying surface permeable to air, a dispersion chamber surmounting said surface and means, particularly vacuum means located under said forming and conveying surface of the non-woven material, which are capable not only of producing an air flow inside the dispersion chamber that allows the fibers inside the chamber to disperse and projects them onto the forming and conveying surface, but also create a vacuum in one zone—called the vacuum zone (9)—of the forming and conveying surface (1) of the non-woven material that extends under the dispersion chamber (2) and downstream from it, with the vacuum speed decreasing between the upstream and downstream parts of said zone (9).

The wall downstream (4) from the vacuum chamber (2) is a plate, and the lower edge (12) of said downstream wall (4) delimits, along with the upper end (1*a*) of the forming and conveying surface of the non-woven material (1), a space for passage whose height is greater than the thickness of the non-woven material (13) coming out of the dispersion chamber (2).

26 Claims, 2 Drawing Sheets

MACHINE FOR MAKING A NON-WOVEN MATERIAL BY AEROLOGICAL MEANS USING A DECREASING AIR FLOW

This application claims priority to a French application No. 03 04048 filed Apr. 1, 2003.

FIELD OF THE INVENTION

This invention concerns the field of manufacturing non-woven materials by aerological means which goes by the technical name "airlay." More specifically, it concerns an improvement of a machine for airlaying a non-woven material that permits a significant increase in the production speed with no detriment to quality of the non-woven material produced.

BACKGROUND OF THE INVENTION

The "airlay" technique basically consists of dispersing individual fibers in a chamber and projecting them onto a moving receptive surface by means of a high-speed air flow; said receptive surface is permeable to air and allows said non-woven material to be formed and conveyed. The term "non-woven" in this text designates the web of fibers formed by the "airlay" technique, even when this web has not undergone any special bonding technique.

Such an "airlay" technique is known particularly from documents U.S. Pat. No. 4,097,965, EP 0 093 585 and FR 2 824 082.

In these three documents, the means of producing an air flow inside the dispersion chamber that allows the fibers to disperse within the chamber and be projected onto the forming and conveying surface consist particularly of vacuum means located below the forming and conveying surface of the non-woven material which is permeable to air.

In document U.S. Pat. No. 4,097,965, the wall downstream from the dispersion chamber is a plate whose lower edge is applied to the surface of the non-woven material coming out of said chamber, with the vacuum tank mounted over the whole surface, which extends perpendicular to the lower edge of the wall upstream and the lower edge of the wall downstream from the dispersion chamber. In this text, the terms "downstream" and "upstream" are defined in relation to the direction in which the forming and conveying surface of the non-woven material moves.

According to the applicant, contact between the lower edge of the downstream wall of the dispersion chamber and the surface fibers of the non-woven material generates friction that can cause irregularities in the non-woven material, especially if the forming and conveying surface of the non-woven material moves at high speed.

In document EP 0 093 585, there is a transverse cylinder at the output of the dispersion chamber that is set in rotation in the direction in which the non-woven material moves. The rotation of this cylinder, which constitutes in some way the lower edge of the wall downstream from the dispersion chamber, makes it possible to limit the friction and hence accompany the surface fibers of the non-woven material when they come out of the dispersion chamber. However, according to the applicant, if you increase the speed at which the non-woven material moves on the forming and conveying surface and, consequently, the speed of rotation of the transverse cylinder, parasitic air flows are produced that interfere with the homogeneity of the non-woven material when it passes under the transverse cylinder.

In document FR 2 824 082, the lower part of the front wall of the dispersion chamber is porous, and the profile of said lower part is preferably curved approximately like the arc of a circle. This prevents the production of parasitic air flows caused by the rapid rotation of the transverse cylinder. However, in operation, the thin microperforated sheet metal that constitutes the lower part of the wall downstream from the dispersion chamber exerts a low compressive force on the non-woven material that slightly compresses it. This prevents the vacuum flow produced by the vacuum tank from causing an incoming air flow that would penetrate inside of the dispersion chamber, passing between the lower edge of the downstream wall and the upper end of the forming and conveying surface of the non-woven material; such an air flow is detrimental to the quality of said non-woven material.

However, according to the applicant, this contact between the thin microperforated sheet metal and the surface fibers of the non-woven coming out of the dispersion chamber causes friction that can deform the non-woven material and produce irregularities on it, and even more so the higher the speed at which the forming and conveying surface of the non-woven material moves.

In document FR 2 824 082, the lower porous part of the front wall of the dispersion chamber can also be comprised of a porous rotary cylinder, particularly a microperforated cylinder. This embodiment makes it possible to avoid friction when the cylinder is driven at a peripheral speed equal to the speed at which the forming and conveying surface of the non-woven material moves. However, some parasitic air play may subsist, even if it is not as much as in document EP 0 093 585.

SUMMARY OF THE INVENTION

The purpose of this invention is to propose an airlay machine for a non-woven material that eliminates the disadvantages of the known machines mentioned above.

This purpose is achieved by the machine in the invention which, as is known particularly from U.S. Pat. No. 4,097,965, has:

- a forming and conveying surface for the non-woven material that is permeable to air,
- a dispersion chamber surmounting the forming and conveying surface,
- means of feeding the fibers intended to form the non-woven material into the dispersion chamber,
- means, particularly vacuum means, located under the forming and conveying surface of the non-woven material that can produce an air flow within the dispersion chamber that makes it possible to disperse the fibers within the chamber and project them onto the forming and conveying surface.

Characteristically, according to the invention, said vacuum means can produce a vacuum in a zone—called the vacuum zone—of the forming and conveying surface of the non-woven material that extends under the dispersion chamber and downstream from it, with a reduction in the vacuum speed between the upstream and downstream parts of said zone.

Thus, because the vacuum is located not only under the dispersion chamber, but also downstream from it, with a vacuum speed that decreases from upstream to downstream, the vacuum flow is controlled perfectly, including any parasitic flows, so as to obtain a perfectly regular non-woven material, even if the forming and conveying surface for said non-woven material moves at high speed.

In another embodiment, the wall downstream from the dispersion chamber is a plate whose lower edge delimits, along with the upper end of the forming and conveying surface of the non-woven material, a space for passage whose height is higher than the thickness of the non-woven material coming out of the dispersion chamber.

Thus, in this particular arrangement, there is no longer any piece that comes in contact with the non-woven material when it comes out of the dispersion chamber.

In another variation, the wall downstream from the dispersion chamber is a rotary cylinder, preferably porous or perforated. This variation is of particular interest when it is necessary to compress the web of fibers to evacuate the air contained between them.

In another variation, the vacuum means are composed of a single vacuum tank in which the vacuum conditions decrease from the upstream to the downstream parts of the vacuum zone.

In another variation, the vacuum means are composed of a multi-stage vacuum tank, with each stage having distinct vacuum conditions.

Preferably, in this latter embodiment, a first stage having the highest vacuum speed V1 is located under the dispersion chamber in the primary section of the vacuum zone extending up to a distance d—preferably from 5 to 20 mm, for example 10 mm— perpendicular to the lower edge of the wall downstream from the dispersion chamber and at least one second stage, developing a vacuum speed V2 slower than V1, extends downstream from the first stage over a secondary section of the vacuum zone. Thus, in this particular configuration, the vacuum speed is not uniform over the whole length of the vacuum chamber; the vacuum speed is the fastest in the primary section, located upstream from the vacuum zone, which corresponds to the first vacuum stage, while it is lower in the secondary section of the vacuum zone that extends beyond the first stage, specifically over the distance d.

In one embodiment, in the secondary section of the vacuum zone, the machine has only one second stage in which the vacuum speed gradually decreases from the upstream to the downstream part of said secondary section.

In one embodiment, in the secondary section of the vacuum zone, the machine has a plurality of successive second stages. The vacuum speed can be constant in each of these second stages or can gradually decrease from the upstream to the downstream part of said stage.

In one embodiment, in the secondary section, the machine has a compressive roller, preferably porous or perforated, placed transversely above the surface conveying the non-woven material that can be applied to the web of fibers beyond the downstream wall of the dispersion chamber.

Preferably, the compressive roller is placed perpendicular to a partition separating two second stages in the secondary section.

DESCRIPTION OF THE DRAWINGS

The characteristics and advantages of the invention will be clearer after reading the following description of different variations of an airlaying machine for non-wovens. This description is given as a non-limiting example and refers to the attached drawings in which.

A first variation (FIG. 1) in which the secondary section of the vacuum zone develops a vacuum speed that continually decreases from upstream to downstream, A second variation (FIG. 2) in which the secondary section of the vacuum zone has five stages in which the vacuum speed is constant.

A third variation (FIG. 3) in which the secondary section of the vacuum zone has five stages in which the vacuum speed itself decreases and, A fourth variation (FIG. 4) in which the secondary section of the vacuum zone has five vacuum stages, some having a constant vacuum speed and others having a decreasing vacuum speed.

Figure 2:
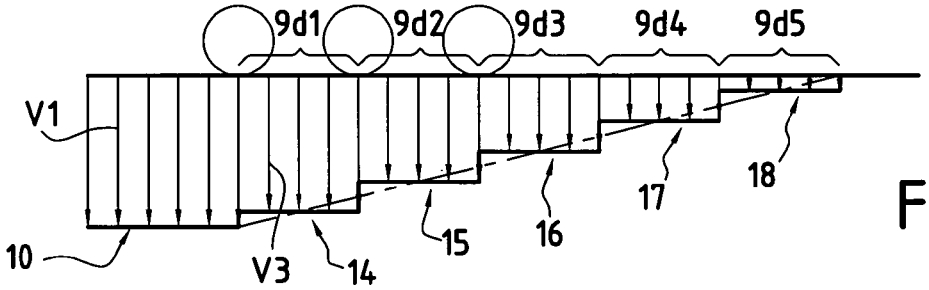
Figure 5:
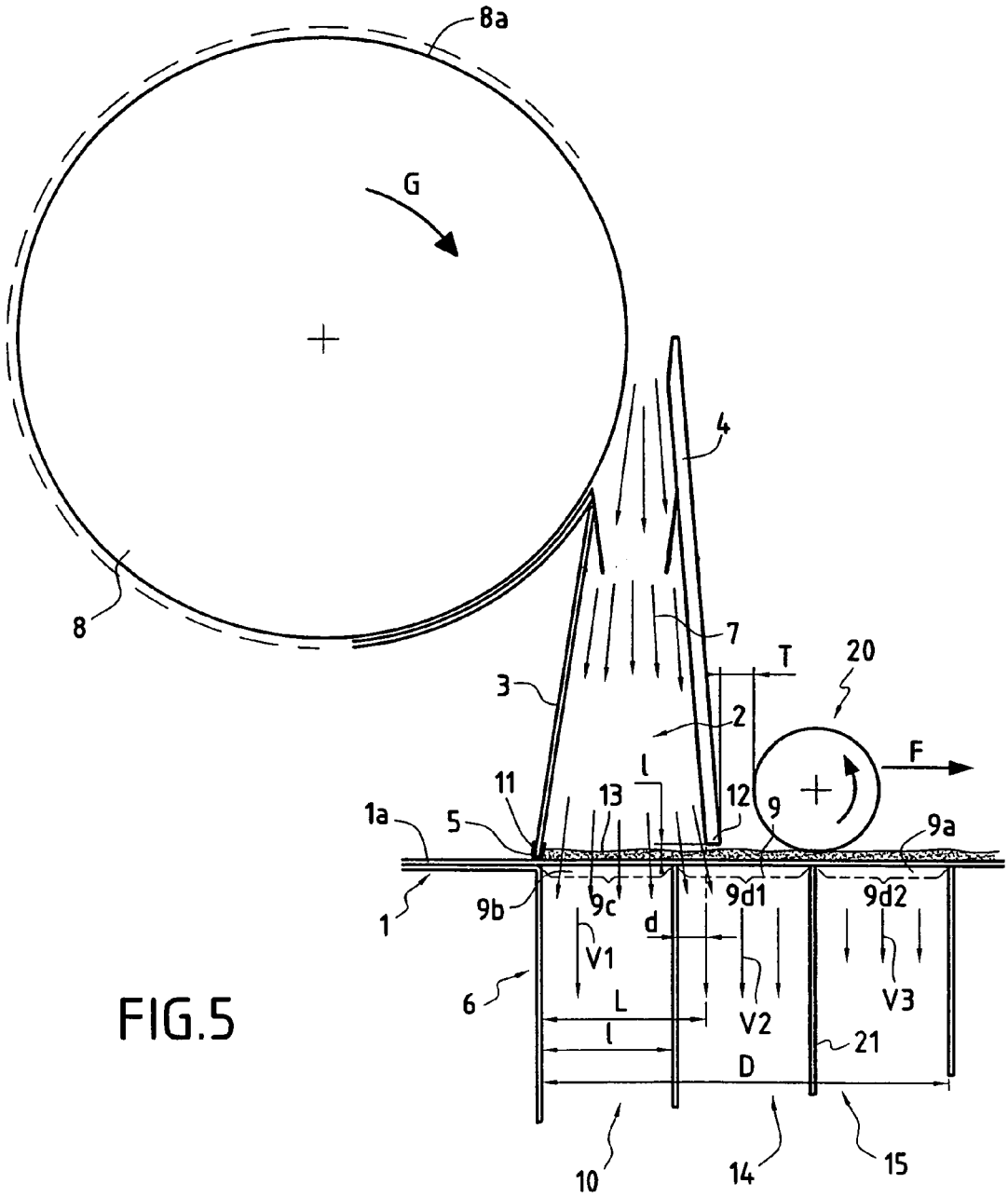

FIG. 5 is a simplified cross-sectional view of a machine for airlaying a non-woven material whose operation is based on the second variation illustrated in FIG. 2.

DETAILED DESCRIPTION OF THE INVENTION

In a way that is known, a machine for airlaying non-woven material has a conveyor using a porous conveyor belt 1 that is mounted under tension on drive rollers. When operating, the upper end 1*a* of this conveyor belt 1, which in the examples illustrated is approximately horizontal, is driven at a constant predetermined speed in the direction of conveyance indicated by arrow F. This upper end 1*a* of the conveyor belt 1 forms a surface permeable to air that makes it possible both to form and to transport the non-woven material.

This machine also has a chamber 2 for dispersion of the fibers, which surmounts the upper end 1*a* of the conveyor belt 1 and which extends over the whole width of this upper end 1*a*. This dispersion chamber 2 has an upstream wall 3 and a downstream wall 4, which extend transversely in the direction F in which the conveyor belt 1 moves, and two longitudinal walls connecting the two walls upstream 3 and downstream 4, which longitudinal walls extend parallel to the direction of movement F.

The lower edges of the upstream walls 3 and longitudinal walls (not shown) are flush with the upper end 1*a* of the conveyor belt 1, and are potentially equipped with a gasket 5 supported on said upper end 1*a*.

Under the upper end 1*a*, there is a vacuum tank which is capable of producing an air flow 7 inside the dispersion chamber 2 symbolized by arrows that makes it possible to disperse the fibers (not shown) inside said chamber 2 and project them onto the upper end 1*a*. The cylinder 8, called the dispersing cylinder, supplies the dispersion chamber 2 with fibers. Potentially, an injection of air through the upper opening in the dispersion chamber may help disperse the fibers.

The tank 6 (or vacuum box) extends, under the upper end 1*a*, over a vacuum zone 9, which zone 9 occupies, in width, at least the width of the dispersion chamber 2 and in length, a distance D that is longer than the length L of the dispersion chamber 2. The vacuum conditions used in the tank 6 are such that the vacuum speed, measured in the tank 6, in the downstream part 9*a* of the vacuum zone 9 is lower than the vacuum speed in the upstream part 9*b* of the vacuum zone 9.

In the examples that will be described below, the vacuum tank 6 is a multi-stage tank, having a first stage 10 which extends under a section called the primary section of the vacuum zone 9, and this primary section 9*c* extends, in length, over a distance 1 which is less than the length L of the vacuum zone 9 surmounted by the dispersion chamber 2.

In other words, referring to FIG. 5, this primary section 9*c* extends from approximately the lower edge 11 of the wall 3 upstream from the dispersion chamber 2 (or slightly downstream from it) to a distance d perpendicular to the lower edge 12 of the wall downstream 4 from the dispersion chamber 2. In this primary section 9*c* of the vacuum zone 9, the vacuum speed V1 is generated at the first stage 10 and is uniform over the whole length 1 of said stage 10.

Figure 1:
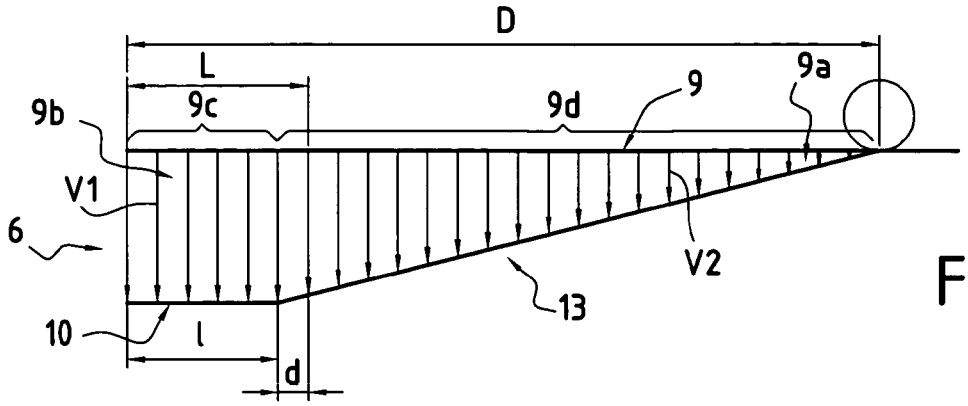
FIGS. 1 to 4 are very schematic representations illustrating the operating principle of the machine in four variations, namely.

In the first embodiment, illustrated in FIG. 1, the vacuum tank 6 has a second stage 13 that covers the second section 9*d* of the vacuum zone, which goes beyond the primary section 9*c* described above. In this second stage 13 of the tank 6, the conditions used are such that the vacuum speed gradually decreases over the whole length of the second section 9*d* from its input to its output, as illustrated in FIG. 1 by the continued decrease in arrows V2, symbolizing the vacuum speed in said secondary section 9*d*.

In the second example illustrated in FIG. 2, the secondary section 9*d* is divided into five subsections $9d_1$, $9d_2$, $9d_3$, $9d_4$, $9d_5$, from upstream to downstream of said secondary section 9*d*. In each subsection, the vacuum speed V3 is constant. This speed V3 decreases from one section to another from the upstream to the downstream part of said secondary section 9*d*. One stage 14 to 18 of the vacuum tank 6 corresponds to each subsection $9d_1$to $9d_5$.

Figure 3:
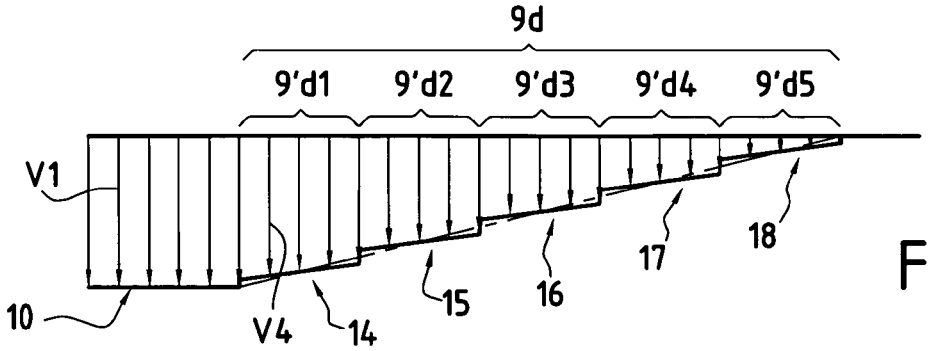

The third example illustrated in FIG. 3 shows the five stages 14 to 18 of the vacuum tank 6 that correspond to secondary vacuum section 9*d* and hence to five subsections $9d_1$, to $9d_5$. In each subsection, the vacuum speed V4 is not constant, but gradually decreases over the length of each stage 14 to 18 from the upstream to the downstream part of each subsection, as can be clearly seen by examining FIG. 3.

Figure 4:
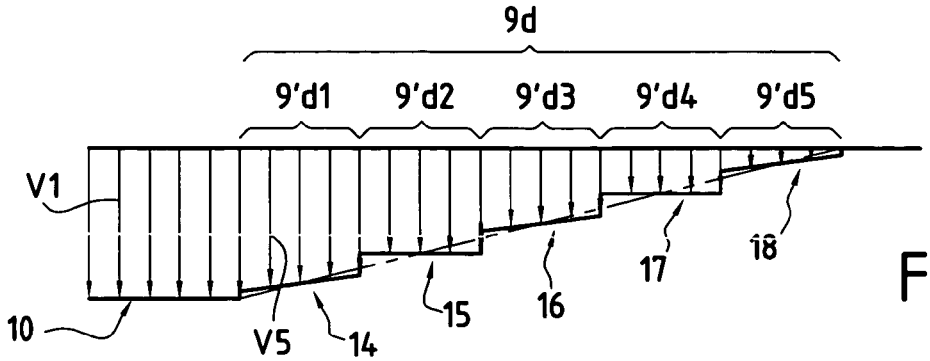

The fourth example of embodiment, which is illustrated in FIG. 4, is a combination of the second and third examples described above, with the vacuum speed V5 gradually decreasing in certain stages 14, 16 and 18, while it stays constant in certain others 15, 17.

The operation of the machine in this invention will now be described more specifically in relation to the example illustrated by FIG. 5.

In FIG. 5, the vacuum tank 6 has three stages, namely the first stage 10, which corresponds to the primary section 9*c* of the vacuum zone 9, and two successive second stages 14 and 15, which correspond to subsections $9d_1$ and $9d_2$ of the secondary section 9*d* of the vacuum zone 9. This number of stages is not exclusive, and can be higher, as in the example shown in FIG. 2, but it may also be two.

The fibers that are fed to the interior of the dispersion chamber 2, on the periphery of the dispersing cylinder 8 are detached from the fittings 8*a* of this cylinder by the action of the air flow produced inside the dispersion chamber 2 and potentially by other means. The fibers are ejected individually inside the dispersion chamber 2, are dispersed by the air flow over the whole horizontal section of said chamber 2 and are projected over the upper end 1*a* of the conveyor belt 1. Due to the accumulation of fibers on the upper end 1*a* when the conveyor belt 1 moves, a non-woven material 13 is formed that is taken to the outside of the dispersion chamber 2, passing at right angles to the wall 4 downstream from said chamber 2, which in the example illustrated is a plate. The spacing between the lower edge 12 of said downstream wall 4 and the upper end 1*a* is set so that it is greater than the thickness of the non-woven material formed in the dispersion chamber 2, which is where it is when it comes out of said chamber 2. This space e is a function of the grams per square meter of the non-woven material. It is from 5 to 50 mm, preferably from 20 to 40 mm, for example 30 mm.

The air flow that moves the fibers inside the dispersion chamber 2 is produced particularly by the vacuum tank 6, more specifically by the vacuum generated by the part of the vacuum section 9 that is at right angles to the dispersion chamber 2. Other additional means could be used, for example an injection of air at the upper part of the dispersion chamber 2, to help detach the fibers from the cylinder 8.

Given that the vacuum speed V1 generated at the first stage 10 of the vacuum tank 6 is the highest, the fibers in the dispersion chamber 2 have a tendency to concentrate on the upper end 1*a* of the primary vacuum section 9*c*, so that the non-woven material 13 is quasi-formed in its final configuration when it comes out of the first stage 10 of the vacuum tank 6.

Beyond that, the non-woven material is taken over in some way by the second stage 14 of the vacuum tank 6 in which the vacuum speed V2 is lower than the speed V1 of the first stage. This takeover occurs when the non-woven material 13 is still inside the dispersion chamber 2 over the distance d, right when the non-woven material 13 has come out of the dispersion chamber 2. This takeover, which continues in the second stage 14 of the vacuum tank 6, does not allow any disturbances caused by the non-woven material passing under the lower edge 12 of the downstream rise 4 of the dispersion chamber 2, since approximately the same system is observed for the air flow on both sides of this downstream rise 4. Due to the vacuum produced beyond the dispersion chamber under the upper end la, no parasitic air flows are seen entering into the vacuum chamber in the space left free between the non-woven material 13 and the lower edge 12 of the downstream rise 4 or at least no lifting detrimental to the fibers is seen.

In the embodiment shown in FIG. 5, there is a compressive roller 20 which is perpendicular to the partition 21 that separates the two successive stages 14, 15 of the secondary section 9*a*. This compressive roller 20 is mounted transversely above the upper end 1*a* of the conveyor belt 1, and is applied to the non-woven material 13. The distance T between the vertical going through the lower edge 12 of the downstream wall 4 and the vertical tangent to the rear of the roller 20 is preferably relatively small, preferably from 10 to 30 mm.

In one preferred example of embodiment, the dispersion chamber 2 has a length L on the order of 60 mm, the length of the main section 9*c* is on the order of 50 mm and the length of the first stage $9d_1$ of the secondary section is on the order of 80 mm. The distance T is on the order of 20 mm for a roller 20 having a diameter on the order of 100 mm.

This is also true when the lower edge of the downstream wall is not the edge of a fixed plate but a revolving element, for example a perforated transverse cylinder which compresses the non-woven material coming out of the dispersion chamber 2.

When it comes out of subsection $9d_1$, from secondary section 9*d* of the vacuum zone 9, the non-woven material is then taken over by the vacuum produced by the next second stage 15 of the vacuum tank 6, whose vacuum speed V3 is less than the vacuum speed V2 of the second stage 14. Potentially, this takeover may be done successively with the other second stages 16 to 18 until there is no longer any vacuum at all beyond the tank 6. This gradual reduction (in stages in this example) in the vacuum in the secondary zone 9*d* allows the fibers of the non-woven material 13 to relax gradually due to the effect of said vacuum. This is what makes it possible to obtain the results wanted, namely the production of a very homogeneous non-woven material under good industrial conditions at high speed.

It is understood that the different parameters, which consist of the choice of vacuum speeds V1, V2, . . . , the length D of the vacuum zone compared to the length L of the dispersion chamber, the distance d, the number of stages of the vacuum tank, the option of keeping the vacuum speed constant or having it decrease in all or some of the second stages—all these parameters are determined individually, depending on the other operating conditions, which are the type and length of the fibers, the grams per square meter desired for the non-woven material and the speed F at which the conveyor belt moves.

In one embodiment, which is not exhaustive, the vacuum speed V1 in the primary section 9*c* of the vacuum zone 9 was around 30 to 90 m/s. Preferably, the vacuum speeds of the five second stages found in the secondary section 9*d* of the vacuum zone 9 were respectively equal to or on the order of 0.8 V, 0.6 V, 0.4 V and 0.2 V, it being known that V is the speed of the first stage the furthest upstream and had a value itself less than $V_1$, for example 0.8 $V_1$. To do this, the first stage at speed V1 of the vacuum tank was equipped with its own fan, while a second fan for the five second stages made it possible to obtain this decreasing vacuum speed using perforated sheets of metal.

However, this invention is not limited to the embodiments which have been described as non-exhaustive examples. In particular, it would be possible to have, transversely above the upper end 1*a* of the conveyor belt 1, other compression rollers designed to accompany the movement of the fibers of the non-woven material, which compression rollers would be located advantageously at right angles to the interface between two successive subsections, or even at right angles to the interface between the primary section 9*c* and the secondary section 9*d* of the vacuum zone.

All suitable means may be used to obtain the vacuum speeds in the vacuum tank, whether from a single fan or a plurality of fans, and from additional elements that could reduce the vacuum speed, potentially in a gradual way, from the upstream to the downstream part of the vacuum zone.

What is claimed is:

1. A machine for making a non-woven material by aerological means comprised of:

a forming and conveying surface for the non-woven material, which is permeable to air, a dispersion chamber surmounting the forming and conveying surface, means of supplying the dispersion chamber with fibers intended to form the non-woven material, vacuum means located under the forming and conveying surface of the non-woven material that produces an air flow inside the dispersion chamber that allows the fibers inside the chamber to disperse and projects the fibers onto the forming and conveying surface, characterized by the fact that said vacuum means produces a vacuum in a vacuum zone of the forming and conveying surface of the non-woven material that extends under the dispersion chamber and downstream from it, with a reduction in vacuum speed between the upstream and downstream parts of said zone.

2. The machine in claim 1, characterized by the fact that the downstream wall of the dispersion chamber comprises a plate, and the lower edge of said downstream wall delimits—along with the upper end of the forming and conveying surface for the non-woven material—a space for passage whose height e is greater than the thickness of the non-woven material coming out of the dispersion chamber.

3. The machine in claim 2, characterized by the fact that the height e is 5 to 50 mm.

4. The machine in claim 3, characterized by the fact that:

the lower edge of the downstream wall is comprised of a rotary cylinder, potentially porous;

the vacuum means are comprised of a single vacuum tank in which the vacuum conditions vary from the upstream to the downstream part of the vacuum zone;

the vacuum means are comprised of a multi-stage vacuum tank, with each stage having distinct vacuum conditions.

5. The machine in claim 4, characterized by the fact that:

in a secondary section of the vacuum zone, it has only one second stage in which the vacuum speed (V2) decreases gradually from upstream to downstream of said secondary section;

in the secondary section of the vacuum zone, it has a plurality of successive second stages.

6. The machine in claim 5, characterized by the fact that the vacuum speed (V3) is constant in each of these second stages.

7. The machine in claim 5, characterized by the fact that:

the vacuum speed (V4) in each of the second stages gradually decreases from upstream to downstream of said stage;

the vacuum speed (V5) is constant in some second stages and gradually decreases from upstream to downstream in other second stages.

8. The machine in claim 7, characterized by the fact that it has at least one compressive roller above the secondary section.

9. The machine in claim 5, characterized by the fact that it has at least one compressive roller above the secondary section.

10. The machine in claim 4, characterized by the fact that at least one compressive roller is disposed above a secondary section of the vacuum zone located downstream of a primary section of the vacuum zone, the secondary section developing a vacuum speed V2 less than a vacuum speed V1 in the primary section.

11. The machine in claim 3, characterized by the fact that at least one compressive roller is disposed above a secondary section of the vacuum zone located downstream of a primary section of the vacuum zone, the secondary section developing a vacuum speed V2 less than a vacuum speed V1 in the primary section.

12. The machine in claim 2, characterized by the fact that the lower edge of the downstream wall is comprised of a rotary cylinder, potentially porous.

13. The machine in claim 2, characterized by the fact that at least one compressive roller is disposed above a secondary section of the vacuum zone located downstream of a primary section of the vacuum zone, the secondary section developing a vacuum speed V2 less than a vacuum speed V1 in the primary section.

14. The machine in claim 1, characterized by the fact that the vacuum means are comprised of a single vacuum tank in which the vacuum conditions vary from the upstream to the downstream part of the vacuum zone.

15. The machine in claim 1, characterized by the fact that the vacuum means are comprised of a multi-stage vacuum tank, with each stage having distinct vacuum conditions.

16. The machine in claim 15, characterized by the fact that a first stage developing the highest vacuum speed (V1) is located under the dispersion chamber in the primary section of the vacuum zone extending up to the distance (d) perpendicular to the lower edge of the downstream wall of the dispersion chamber and by the fact that at least one second stage, developing a vacuum speed V2 less than V1 extends downstream from the first stage over a secondary section of the vacuum zone.

17. The machine in claim 16, characterized by the fact that the distance d is from 5 to 20 mm.

18. The machine in claim 16, characterized by the fact that in the secondary section of the vacuum zone, it has only one second stage in which the vacuum speed (V2) decreases gradually from upstream to downstream of said secondary section.

19. The machine in claim 16, characterized by the fact that in the secondary section of the vacuum zone, it has a plurality N of successive second stages.

20. The machine in claim 19, characterized by the fact that the vacuum speed (V3) is constant in each of these N second stages.

21. The machine in claim 19, characterized by the fact that the vacuum speed (V4) in each of the N second stages gradually decreases from upstream to downstream of said stage.

22. The machine in claim 19, characterized by the fact that the vacuum speed (V5) is constant in some second stages and gradually decreases from upstream to downstream in other second stages.

23. The machine in claim 16, characterized by the fact that at least one compressive roller is disposed above the secondary section.

24. The machine in claim 23, characterized by the fact that:

in the secondary section of the vacuum zone, it has a plurality N of successive second stages; and the compressive roller is placed at right angles to the interface between two successive second stages.

25. The machine in claim 24, characterized by the fact that the compressive roller is a short distance (T) from the perpendicular of the lower edge of the downstream wall of the dispersion chamber, preferably a distance from 10 to 30 mm.

26. The machine in claim 23, characterized by the fact that the compressive roller is a short distance (T) from the perpendicular of the lower edge of the downstream wall of the dispersion chamber, preferably a distance from 10 to 30 mm.

* * * * *